United States Patent [19]

Erhard et al.

[11] Patent Number: 5,031,593

[45] Date of Patent: Jul. 16, 1991

[54] SYSTEM FOR CONTROLLING THE CARBURETOR OF AN INTERNAL COMBUSTION ENGINE

[75] Inventors: Werner Erhard, Cadolzburg; Werner Flügel, Oberasbach, both of Fed. Rep. of Germany

[73] Assignee: Prüfrex-Electro-Apparatebau Inh. Helga Müller, geb. Dutschke, Cadolzburg, Fed. Rep. of Germany

[21] Appl. No.: 555,286

[22] Filed: Jul. 19, 1990

[30] Foreign Application Priority Data

Jul. 22, 1989 [DE] Fed. Rep. of Germany ..... 3924353

[51] Int. Cl.[5] ..... F02D 41/02; F02M 7/04; F02B 63/02

[52] U.S. Cl. ..... 123/331; 123/361; 123/438; 123/403

[58] Field of Search ..... 123/330, 331, 339, 344, 123/361, 394, 399, 403, 438, 440; 364/431.12; 261/DIG. 74

[56] References Cited

U.S. PATENT DOCUMENTS

| | | | |
|---|---|---|---|
| 3,807,371 | 4/1974 | Nutten et al. | 123/330 X |
| 4,125,095 | 11/1978 | Wilson | 123/344 |
| 4,462,357 | 7/1984 | Lockhart | 123/361 X |
| 4,463,723 | 8/1984 | Tansuwan | 123/438 |
| 4,524,742 | 6/1985 | Bonfiglioli et al. | 123/438 |
| 4,675,589 | 6/1987 | Sausner et al. | 123/361 X |
| 4,763,264 | 8/1988 | Okuno et al. | 123/361 X |
| 4,768,478 | 9/1988 | Martel | 123/438 X |
| 4,831,985 | 5/1989 | Mabee et al. | 123/361 X |
| 4,884,541 | 12/1989 | Marriott | 123/361 |

*Primary Examiner*—Willis R. Wolfe
*Attorney, Agent, or Firm*—Jordan and Hamburg

[57] ABSTRACT

A control system for the carburetor of an internal combustion engine wherein the carburetor has a choke valve disposed at the inlet of the carburetor induction tube and the choke valve is operated automatically by an actuator. The actuator for the control includes a pulse-width modulator in which the pulse width or the degree of modulation is influenced by a family of characteristics stored in a programmable memory, the memory applying signals to the pulse-width modulator for pre-specified air-fuel mixtures in accordance with engine speed.

14 Claims, 1 Drawing Sheet

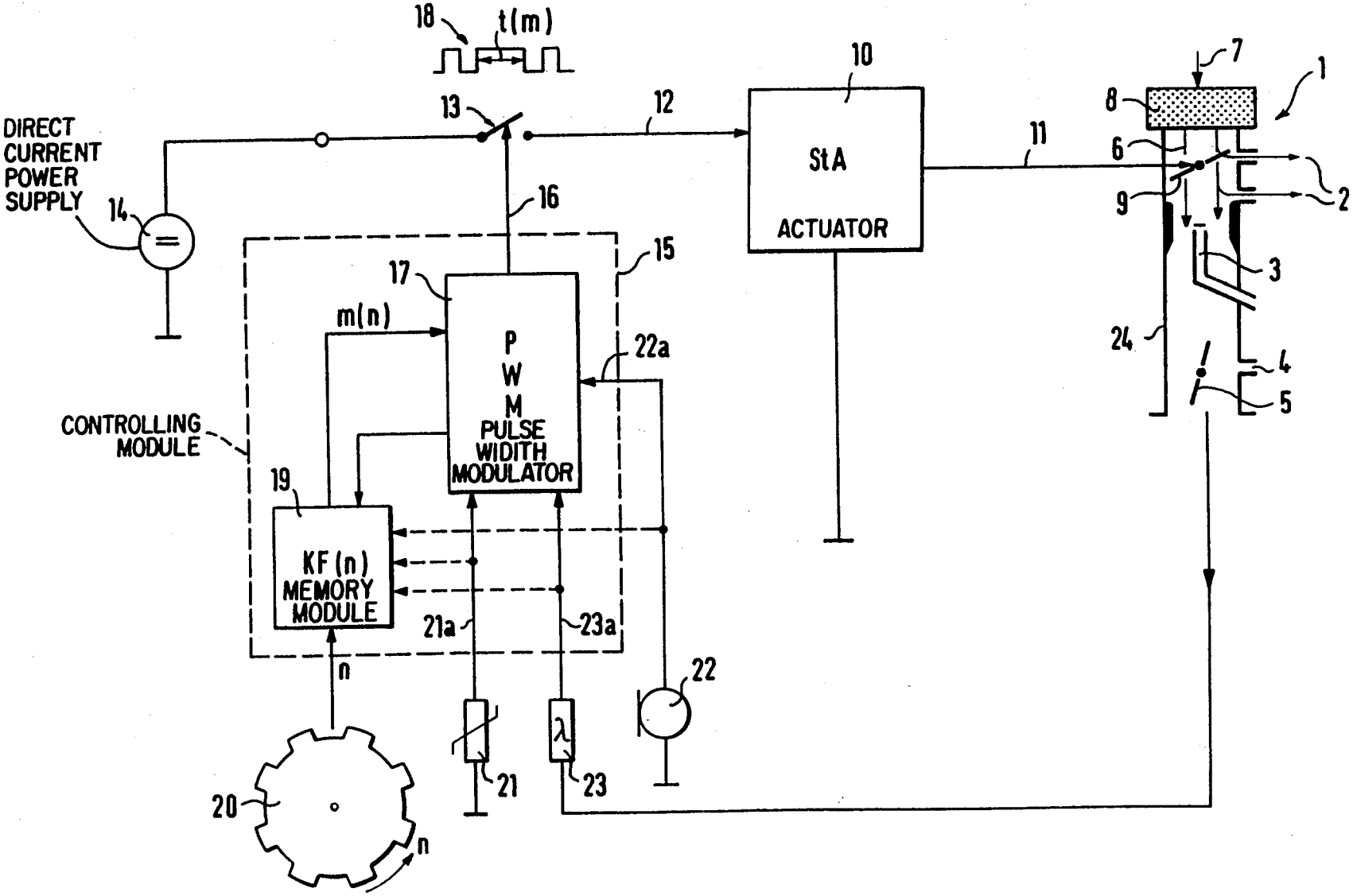
StA
ACTUATOR
P
W
M
PULSE
WIDITH
MODULATOR
KF (n)
MEMORY
MODULE
t(m)
m(n)
n
DIRECT
CURRENT
POWER
SUPPLY
CONTROLLING
MODULE

SYSTEM FOR CONTROLLING THE CARBURETOR OF AN INTERNAL COMBUSTION ENGINE

FIELD OF THE INVENTION

The invention relates to a system for controlling the carburetor of an internal combustion engine, especially for lawn mowers, chain saws or cutoff grinders, wherein a choke valve is disposed at the entrance of the carburetor draft tube and wherein the choke valve can be operated automatically by a servo mechanism.

BACKGROUND OF THE INVENTION

Such choke valves are comparable with known starter valves which shut off the entry of the main air into the carburetor so as to produce an especially rich mixture in the carburetor when a cold engine is being started. When the piston descends in the cylinder of the engine, a very strong pumping action is then produced in the carburetor, so that the high vacuum will draw large amounts of fuel both from the mixer tube and from the idler system of the carburetor. Such starter valves or choke valves can be operated either by hand (with a choke lever) or automatically (with an automatic choke).

At the present time it is known that the maximum engine speed can be attained by enriching the fuel in the air-fuel mixture. However, establishing the maximum engine speed by enriching the mixture is comparatively inaccurate. The engine speed is therefore set at about 14,000 rpm, even though the engine has its maximum power at about 9,000 rpm. At 14,000 rpm, limiting the speed by reducing the fuel feed can easily lead to the destruction of the engine. Another undesirable aspect of known carburetor operation is that at maximum engine speed, which is achieved by enriching the fuel in the air-fuel mixture, a very great amount of unburned fuel is exhausted. The adverse effect of this on efficiency is obvious, and it also results in an extraordinary discharge of toxic substances, resulting in pollution of the environment.

SUMMARY OF THE INVENTION

There is consequently a great need to design a carburetor control such that an optimum air-fuel mixture will be available to the internal combustion engine operated therewith, at which the engine will develop optimum power and at the same time a minimum of toxic exhaust. To solve this problem and avoid the above-named disadvantages in accordance with the invention, in a control system of the kind described above, the servo mechanism for the control is a pulse-width modulator in which the pulse width or degree of modulation is affected by a family of characteristics stored in a read-only memory, and the memory is connected to send signals to the pulse-width modulator for pre-specified air-fuel mixtures independently of the engine speed.

In this manner, it is possible to operate a carburetor choke valve so that the internal combustion engine can be throttled to the speed at which it outputs the greatest power and emits a minimum amount of pollutants. The internal combustion engine has, for every speed, an air-fuel mixture optimized with regard to power and polluting exhaust which can be determined specifically for each engine and then can be stored in programmable memories in corresponding data (tables) organized in families of characteristics. The pulse-width modulator is coupled to these storage systems and emits a pulse signal with a variable duty cycle, for example to an analog servo motor. This servo motor then forms the automatic actuating means for setting the choke valve in the carburetor. This system or carburetor control enables the machine to be regulated to the speed at which it gives optimum power with minimum pollution. Elevation of the speed can be prevented by reducing the fuel feed and by electronic spark suppression and ignition timing (cf. German Federal Patent Application P 38 17 471.5). Particularly when the servo system employs an analog servo motor, an especially precise carburetor setting at, e.g., 9000 rpm, will be the result; the engine speed will remain very constant and a high power yield will be attained.

In a further development of the invention, power from a separate magneto, such as is already used for heating the handles of chain saws, is used also for the servo control of the choke valve and it is simultaneously subjected to the pulse-width modulation. In further improvement of the invention, a switching element is connected in the supply line to the servo drive, and is opened and closed by the pulse-width modulator as a function of the pulse width or degree of modulation. This embodiment of the invention provides an especially simple and low-cost circuit.

According to another embodiment of the invention, the pulse width or degree of modulation of the pulse-width modulator is additionally influenced by an engine temperature sensor, a lambda probe and/or a knock sensor known to a person skilled in the art. With the aid of these additional data the pulse-width modulator can recognize very precisely the state of operation of the engine, can access the family of characteristics stored in memory and adjust the choke accordingly via the actuator. It is within the scope of the invention to design the pulse-width modulator and/or the memory that stores the family of characteristics coupled therewith by a circuit or programmed microcomputer specific to the engine or to a client.

BRIEF DESCRIPTION OF THE DRAWING

Additional features, details and advantages of the invention will be found in the following description of an embodiment of the invention, with the aid of the accompanying drawing. The drawing is a block diagram of a carburetor control system in accordance with the invention.

DESCRIPTION OF THE PREFERRED EMBODIMENT

In a carburetor 1, which is commonly provided with an idling system 2, a mixer tube 3, an idle mixture passage 4 and a main throttle valve 5, a choke valve 9 is disposed at the carburetor air intake 6 following the air filter 8 in the direction 7 of air flow. This throttle valve is adjustable about a central axis perpendicular to the plane of drawing, by about 90°, so that a specific enrichment of the mixture can be achieved in a known manner.

The rotation of the choke valve 9 is produced by an actuator 10, as indicated diagrammatically by the action line 11. The actuator can be, for example, an electronic stepping motor or a linear actuator. Its controlling input 12 is connected via a switching device, e.g., a transistor or thyristor, to a direct-current power supply 14 which can be fed by a direct-current generator, or an alternating-current generator with a rectifier, coupled to the internal combustion engine (not shown). The switching device 13 is actuated to turn the output 16 of a control module 15 on and off. The control module 15 contains as its functioning unit a pulse-width modulator (PWM) 17 which opens and closes the switching device 13 for a specific time t, depending on the degree of modulation or the pulse duty cycle m. This time depends upon the degree of modulation m determined by the pulse-width modulator to produce a pulse series 18 of, for example, the kind illustrated with a variable pulse width or duration t, for the controlling input 12 of the actuator (StA). In order to determine the degree of modulation or pulse duty cycle of the pulse series 18, the pulse-width modulator 17 interrogates a memory module 19 integrated in the controlling module 15 in memory, storing characteristics dependent upon the engine speed n. These characteristics are predetermined for a specific engine, so that the memory module 19 can advantageously be an electrically programmable read-only memory.

Furthermore, the controlling module 15 requires as an input parameter the engine speed n. This parameter is derived from a rotating toothed segment wheel 20 or a rotating magnetic pole wheel, or the like, rotating with the engine, as represented, and can be applied directly to the memory module 19 that stores the speed-related characteristics. The pulse-width modulator can consequently read degrees of modulation or duty cycles m (n) specific for each engine speed from the memory module 19, and accordingly close or open the switching device 13 for a specific amount of time t (m).

The invention is not limited to control of the choke as a function of speed. Motor temperature sensors 21, knock sensors 22 and lambda (λ) probes 23 can be provided, the latter being coupled to the induction tube 24 of the carburetor. Their data outputs 21*a*, 22*a*, 34*a*, can either additionally affect the operation of the pulse-width modulator or, as indicated in broken lines in the drawing, the characteristic output of the memory module 19 to the pulse-width modulator 17. The controlling module 15 can advantageously be either a custom-designed circuit or a microcomputer with a program specific to the engine.

In such a case, a microcomputer which is already used to control the ignition of the engine (see German Federal Patent Application P 39 14 026.1) can also serve for the present control system In this manner, computer capacity, which as a rule is not fully utilized, can be used in a cost-effective manner. This idea can be further extended by integrating it, as an ignition and carburetion control system, into an over-all motor management system.

It will be understood, of course, that the representation of the invention in the drawing is only schematic. Thus, for example, the segment wheel 20 may be coupled in conventional manner to a pickup coil (not shown), to apply the pulses n to the control module 15 at a rate corresponding to the speed of the engine. Employing a microcomputer for the control module, the control module may contain a program, employing the timer of the microcomputer, to convert the pulse rate of the pulses n to an address for the memory module 19. The pulse-width modulator 17 may constitute a program in the microcomputer adapted to interrogate the memory module 19 for data relating to the pulse width of the pulses that are required for the current operation of the engine. Similarly, the signals from the sensors 21 and 22 and probe 23 may be converted in the microcomputer to modify the address signals applied to the memory module 19, or the pulse-width modulator may interrogate these devices to determine any required modification of the pulse width of the pulses output to the switching module 13.

While the invention has been described with reference to a single embodiment, it will be apparent that variations and modifications may be made therein, and it is therefore intended in the following claims to cover each such variation and modification as falls within the true spirit and scope of the invention.

What we claim is:

1. A control system for the carburetor of an internal combustion engine, wherein the carburetor has a choke valve mounted at the inlet of a carburetor induction tube, and an actuator is provided for automatically operating the choke valve, the improvement comprising a pulse width modulation means, a programmable memory having stored therein a family of characteristics corresponding to prespecified air-fuel mixtures as a function of engine speed, means for producing a timing signal corresponding to the speed of the engine, means responsive to said timing signal for applying a control signal from said memory to said pulse width modulation means that corresponds to a predetermined air-fuel mixture at the speed corresponding to the timing signal, said pulse width modulation means comprising means for outputting a pulse signal that is width modulated as a function of said control signal, and means responsive to said modulated pulse signal for controlling said actuator.

2. The control system of claim 1 further comprising a power supply, said means responsive to said modulated pulse signal comprising means for coupling said power supply to said actuator as a function of the timing of said modulated pulse signal.

3. The control system of claim 2 wherein said power supply is a direct current supply, and said means for coupling said power supply to said actuator comprises switching means.

4. The control system of claim 1 further comprising means responsive to the temperature of said engine for controlling the modulation by said modulating means.

5. The control system of claim 1 further comprising lambda probe means connected to control the modulation by said modulating means.

6. The control system of claim 1 further comprising knock sensor means connected to control the modulation by said modulating means.

7. The control system of claim 1 wherein the pulse-width modulator comprises an integrated circuit.

8. The control system of claim 1 wherein said memory comprises an integrated circuit.

9. The control system of claim 1 wherein said pulse width modulating means and memory comprise elements of a programmed microcomputer.

10. The control system of claim 1 wherein said actuator is an analog servo motor.

11. A control system for the carburetor of an internal combustion engine, wherein the carburetor has a choke valve mounted at the inlet of a carburetor induction tube, and an actuator is provided for automatically operating the choke valve, the improvement comprising a programmable memory having stored therein a family of characteristics corresponding to predetermined air-fuel mixtures as a function of engine speed, means for producing a timing signal corresponding to the speed of the engine, means responsive to said timing signal for addressing said memory to output a modulation signal that corresponds to the predetermined air-fuel mixture for the current speed of the engine, means responsive to said modulation signal for generating a pulse width modulated signal, and means responsive to said modulated pulse signal for controlling said actuator.

12. The control system of claim 11 wherein said means responsive to said timing signal comprises means for converting said timing pulses to an addressing signal.

13. The control system of claim 11 wherein said means for generating a pulse width modulated signal comprises a pulse width modulator connected to receive said modulation signal from said memory.

14. The control system of claim 11 wherein said control system comprises a microcomputer, said means for addressing said memory and means for generating a pulse width modulated signal comprising program means in said microcomputer.

* * * * *